United States Patent [19]

De Lima Castro Netto

[11] Patent Number: 4,520,534

[45] Date of Patent: Jun. 4, 1985

[54] SLIDING CLOSURE ASSEMBLIES

[76] Inventor: Eduardo De Lima Castro Netto, Rua São Luiz Gonzaga No. 912, Rio de Janeiro, Brazil

[21] Appl. No.: 455,623

[22] Filed: Jan. 4, 1983

[30] Foreign Application Priority Data

Jan. 22, 1982 [BR] Brazil ..... 8200339

[51] Int. Cl.[3] ..... A44B 17/00

[52] U.S. Cl. ..... 24/399; 24/437; 24/441

[58] Field of Search ..... 24/399, 400, 415, 437, 24/441

[56] References Cited

U.S. PATENT DOCUMENTS 3,074,137 1/1963 Hawley ..... 24/400
3,959,856 6/1976 Ausnit ..... 24/399

FOREIGN PATENT DOCUMENTS 406129 2/1934 United Kingdom .
465080 4/1937 United Kingdom .
509995 7/1939 United Kingdom .
529155 11/1940 United Kingdom .
610579 10/1948 United Kingdom .
633675 12/1949 United Kingdom .

*Primary Examiner*—Philip C. Kannan
*Attorney, Agent, or Firm*—Beveridge, DeGrandi and Weilacher

[57] ABSTRACT

There is described a sliding closure intended for use with a bag or the like, the closure comprising two track parts (2,3,60,61) extending along opposite sides of an opening in the bag (1), and fixed thereto, and a closure element (20) composed of a plurality of articulated segments (21) which engage enlarged rail portions (**2*a*, 3*a*) of the tracks to hold the tracks together. The closure is described in relation to postal envelopes and mailbags, and in relation to the various alternative embodiments there are described guides (5, 6, 7, 30, 31, 53, 53*a*) for the sliding closure element, end stop assemblies (10, 53**), and a sealing arrangement is envisaged.

14 Claims, 9 Drawing Figures

53
54
55
56
56

58
57
54
53
56
48
49
VI
VI

SLIDING CLOSURE ASSEMBLIES

The present invention relates to sealing mechanisms for bags, particularly to lightweight easily operable and secure closures which cannot be opened undetectably.

The present widely used types of sealable bags, mostly used as re-useable mailing envelopes between branch offices of larger firms, are generally provided with a normal sliding fastener of the zip type. The slider of the fastener in these known types of envelope is held in the closed position by means of a non-reusable plastics seal element, preventing the undetected opening of the zip. However by inserting a levering tool between the teeth of the zip, the zip may be opened. The teeth of the zip may then be replaced in their original positions, the last tooth being forced into position by a sharp push. Thus, the bags of the prior art are openable without breaking their seals.

The object of the present invention is to provide a lightweight sealable envelope which is simply and inexpensively fabricated, and can be sealed effectively to prevent undetected entry.

According to the present invention, a sliding closure device for an opening in a bag or the like includes two track parts, each comprising a rail and a fixing portion, extending along opposite sides of the opening and an elongate closure element comprising a plurality of substantially identical articulatedly joined segments, each having at least one passageway extending in the longitudinal direction of the element and an open slot communicating with each passageway along its length, the rails being slidingly receivable in the or a respective passageway with the fixing portions joined to the bag fabric via the or a respective slot. The closure member slides between a closed position in which the closure element extends along substantially the entire length of the track parts, and an open position in which the closure element has at least its major portion extending beyond one end of the track parts, and the closure device may further include means for immobilising the closure element relative to the track parts when the element is in the closed position.

Preferably, at one end of the track parts is provided a tubular guide element, which aligns the closure element with the ends of the track parts to facilitate opening and closing of the device.

In an advantageous embodiment of the device, the immobilising means operates between the closure element and said guide element.

Another preferred feature is the provision of a stop element at the end of the track remote from the guide element, the stop element preferably enclosing the end segment of the closure element to prevent tampering therewith when the closure element is in its closed position.

An application of the present device to envelopes envisages the provision of two passageways in each segment, each passageway engaging a single track part. Alternative arrangements, in which two or more track parts are engaged in a single passageway are also considered within the scope of the present invention.

The segments of the closure member may be joined by any suitable means; a preferred joining system is by means of a flexible filament or filaments extending through aligned bores in the segments. The filaments may be of reinforced plastics, or of metal wire.

The parts of the closure device are preferably all formed of plastics material, the track parts, guide element and stop element being welded to the bag, which is also preferably of welded plastics construction.

Three embodiments of the present invention will now be described, with reference to the attached drawings in which FIG. 1 is an exploded cutaway perspective view of one end of one embodiment of the present closure, seen from within an envelope.

Figure 1:
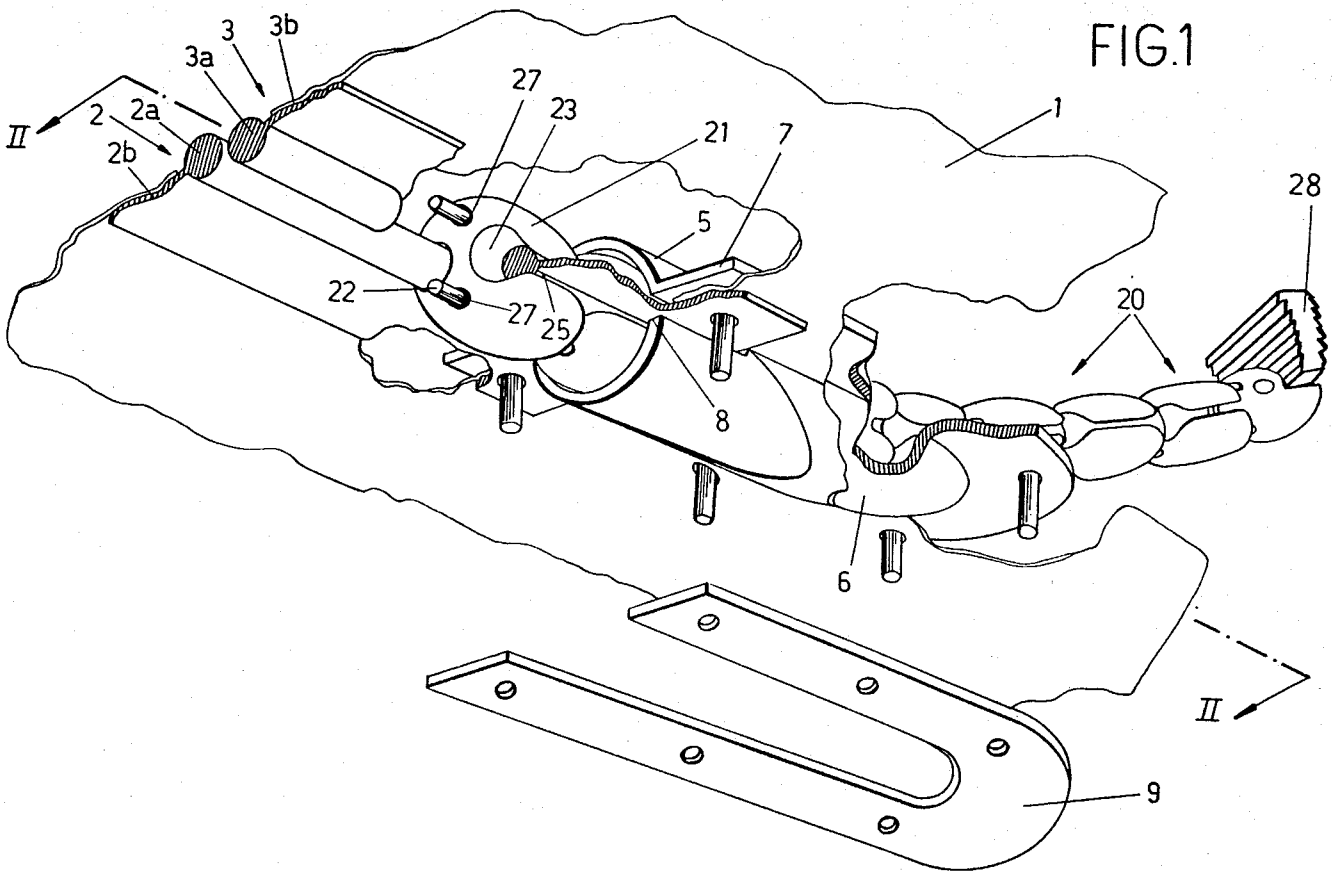
Figure 2:
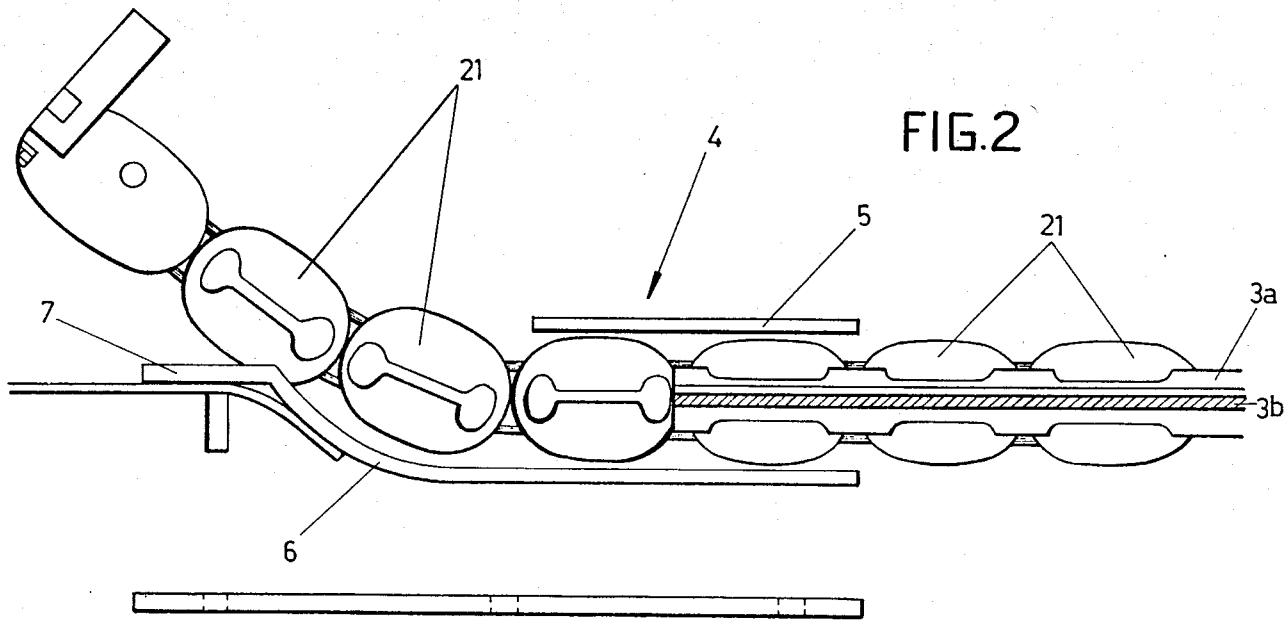
FIG. 2 is a longitudinal sectional view of the closure of FIG. 1, taken on line II—II of FIG. 1.
Figure 3:
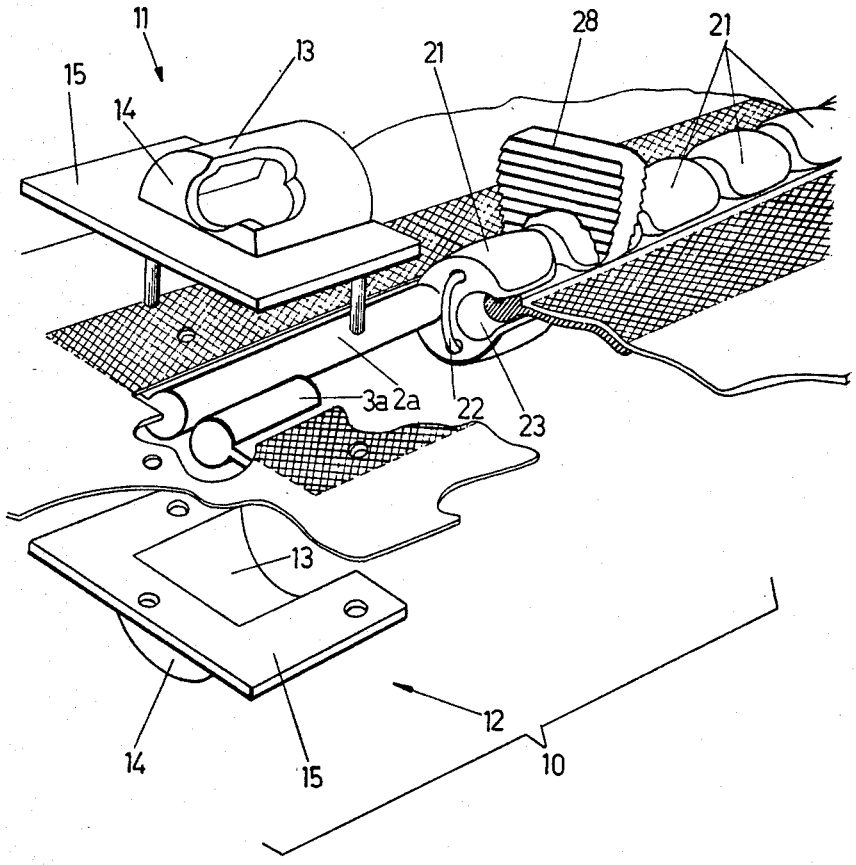
FIG. 3 is an exploded cutaway perspective view of the other end of the closure of FIGS. 1 and 2.

Referring now to FIGS. 1 to 3, there are shown therein detail views of an envelope incorporating the closure of the present invention. The envelope will be generally rectangular and planar and preferably will be formed of plastic material with welded seams. The closure will preferably be positioned parallel to and adjacent an edge of the envelope, and is formed by first providing a narrow slot in one of the envelope's sides 1. To the sides of the slot are attached two track pieces 2 and 3. In the embodiment shown, the track pieces have a generally cylindrical rail part *2a*, *3a* and a planar longitudinal fixing flange *2b*, *3b* along one side. The flange is attached to the envelope material preferably by welding.

At one end of the slot is positioned a guide element, which includes a short tubular portion 5. At one end of the tubular portion 5, a chute 6 extends from the lower half of the tubular portion, the chute curving upwardly to terminate in the axial plane of the tubular portion 5. A U-shaped flange 7 extends along both sides of the tubular portion and around the end of chute 6, the flange being adapted to fix the guide element to the envelope material, and to the flanges *2b*, *3b*.

As may be understood from FIGS. 1 and 2, the guide element is mounted so that the tracks 2, 3 extend partially into the tubular portion 5, at its end remote from chute 6. Slots 8 may be provided adjacent flange 7 at this end of the tubular portion 5 to accomodate the flanges *2b*, *3b* of the tracks.

Final fixing of the guide element of FIGS. 1 and 2 is achieved by a second flange 9, corresponding in shape and size to flange 7, which is fixed thereto to trap both the envelope fabric 1 and the track flange ends *2b*, *3b*, between flanges 7 and 8.

The size of the slot cut in the envelope material 1 is such that the end of the slot passes below the chute 6, access to the bag interior being prevented by the trapping of the envelope material between the flanges.

At the other end of the slot in the envelope, a stop 10 is provided. The stop comprises upper and lower halves 11 and 12, each of which comprises a semicircular bridge 13 closed at one side by a wall 14, the ends of the bridge, and the wall, being attached to a flange 15. When assembled, the envelope material and the ends of track flanges *2b, 3b* are sandwiched between the flanges 15 of the upper and lower halves, with the tracks 2, 3, extending into the closed-ended tunnel formed by the two bridges 13.

In order to close the envelope, a sliding closure element 20 is provided, the closure element being of such a length that it may extend from the interior of the stop 10 to the end of the tubular portion 5 of the guide element remote therefrom.

The sliding closure element is composed of a number of segments 21, connected by means of a flexible filament 22.

Each segment is generally cylindrical, the ends of each segment being slightly rounded. Two axially extending passageways 23 and 24 are formed in each segment, the passageways being in communication with narrow slots 25 and 26 running along the sides of the segment. The configuration of each segment is such that the enlarged cylindrical rail parts *2a, 3a,* of the tracks are received within the passageways 23, 24, and the flanges *2b, 3b* extend out of the slots 25, 26. Due to the relative enlargment of the rail parts *2a, 3a,* the segments may slide along the tracks but the tracks may not be pulled laterally out of engagement with the segments.

Each segment is made of substantially rigid material, preferably plastics. To assemble the sliding closure element, a plurality of segments are strung on a filament 22, the filament passing through aligned bores 27 in each segment. The bores 27 may be enlarged at their ends, to facilitate flexing of the assembled element.

To assemble the closure, first the tracks are secured to the sides of the slot formed in the envelope fabric 1, preferably by welding.

The two halves 11 and 12 of the stop 10 are then fixed in place; in the embodiment shown the flanges 15 are provided with cooperating pins and openings for alignment the halves either being welded or fixed by means of heat-sealing the pins into the holes.

The guide element is then fixed in place, with the ends of the track flanges *2a, 2b* fitting into the slots 8, and being trapped with the envelope material between the guide element flange 7 and the second flange 9.

The assembled sliding closure element is then introduced into tubular portion 5 of the guide element 4, by placing its leading end in chute 6 and pushing. Track parts *2a, 3a* enter the passageways of each successive segment as the sliding closure 20 continues to move therealong. Eventually the leading end of the sliding closure 20 reaches the stop 4, and the envelope is then completely closed.

At this point, a resilient sealing means may be applied to suitable complementary configurations on either the stop or the guide element and a segment therein, to prevent undetected release of the closure. The sealing means may be of any suitable type, for example that disclosed in our Brazilian Patent Application No. PI 7501943.

Opening of the closed envelope will involve first breaking the seal, then sliding the closure member to a position where the major part of the closure member extends out of the tubular portion 5 of the guide element from the chute 6 end. The tracks 2 and 3 may then be flexed to form an access opening into the envelope.

To simplify operation of the sliding closure, one or more segments 21 near its ends may be provided with gripping tabs 28. The grip tab 28 at the leading end of the closure element will serve the added function of retaining the sliding closure element 20 in the assembled condition i.e. it will prevent it from being withdrawn completely from the tracks 2, 3, as the grip tab 28 will not pass through the tubular portion 5 of the guide element.

However, when grips 28 are provided on closures used with the guide elements described and illustrated in FIGS. 1 and 2, the sliding closure element must be assembled in position, i.e. the segments of the closure element are theaded on to the filaments, starting with the terminal grip segment, until all but the other grip segment are assembled. The closure element is then passed through the guide element, and the final grip segment is threaded on to the filament 27. The filament 27 is then made secure, as by welding, to the end segment of the closure element.

Figure 4:
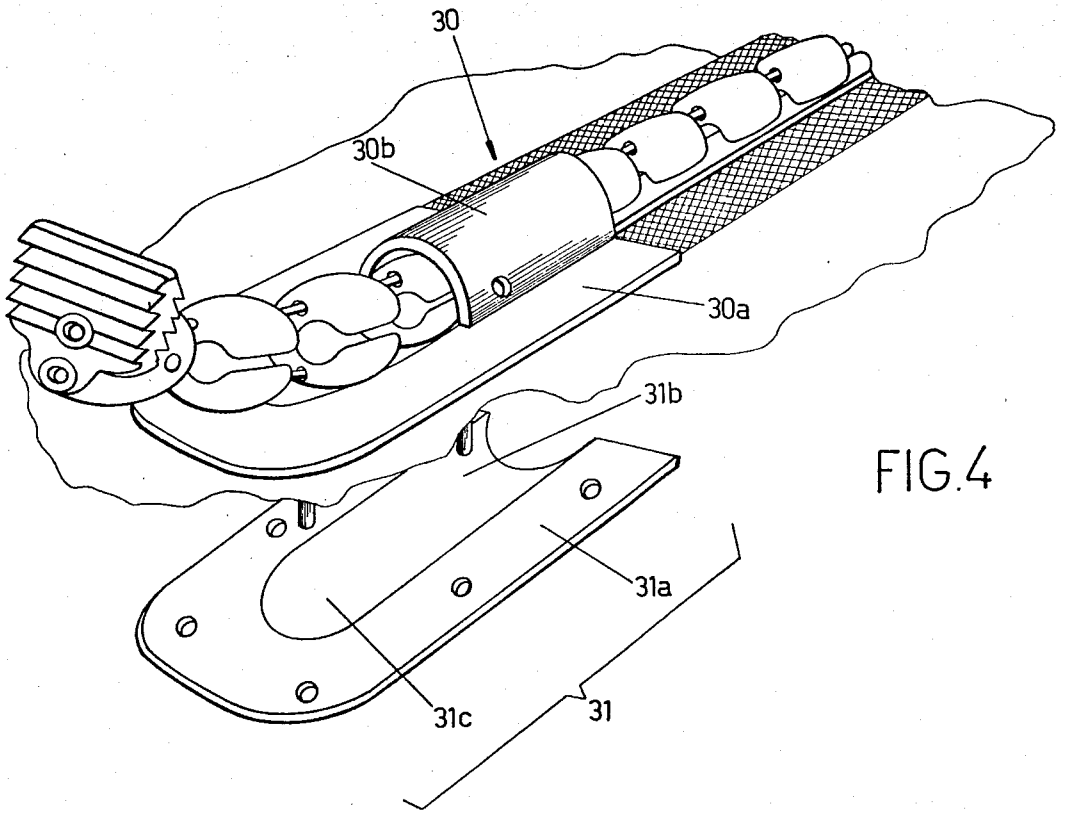
FIG. 4 is an alternative configuration of the elements shown in FIGS. 1 and 2.

Clearly, this may necessitate manual assembly of the closures, which may be avoided by using the alternative guide element of FIG. 4, wherein the closure element is pre-assembled and partially slid on to the tracks prior to assembly of the guide element halves.

The guide element shown here comprises two parts, an upper half 30 and a lower half 31. The upper half 30 is in the form of a planar U-shaped flange 30*a*, the flange having a rounded end and a pair of parallel legs. The free end regions of the legs are connected by a bridge 30*b* which is approximately semicylindrical in form and extends from the free ends of the legs to about their midportions.

The lower half 31 of the guide element composes a U-shaped flange 31*a*, corresponding in size and shape to the flange 30*a* of the upper half 30. Between the free ends of the legs of the flange 31*a*, there extends a substantially semicylindrical trough part 31*b*, which at the end nearest the rounded part of the flange, decreases in depth to form a chute 31*c*.

The guide element of FIG. 4 is assembled in the same manner as that previously described, save that the ends of the tracks 2, 3 have their flanges *2b, 3b* trapped between the flanges 31*a*, 30*a* of the two guide element halves 30, 31 with the envelope material. To facilitate a tight engagement, one or other of the flanges 30*a*, 31*a* may be formed with a step whose height may be equal to the thickness of the track flange *2b, 3b,* or may depend on the envelope material thickness, the step giving increased clearance between the flanges 30*a*, 31*a* at the end of the guide element remote from the chute 31*c*.

The FIG. 4 embodiment is advantageous in that it is moulded simply in a two part mould, or may even be stamped from sheet metal.

Figures 5, 7:
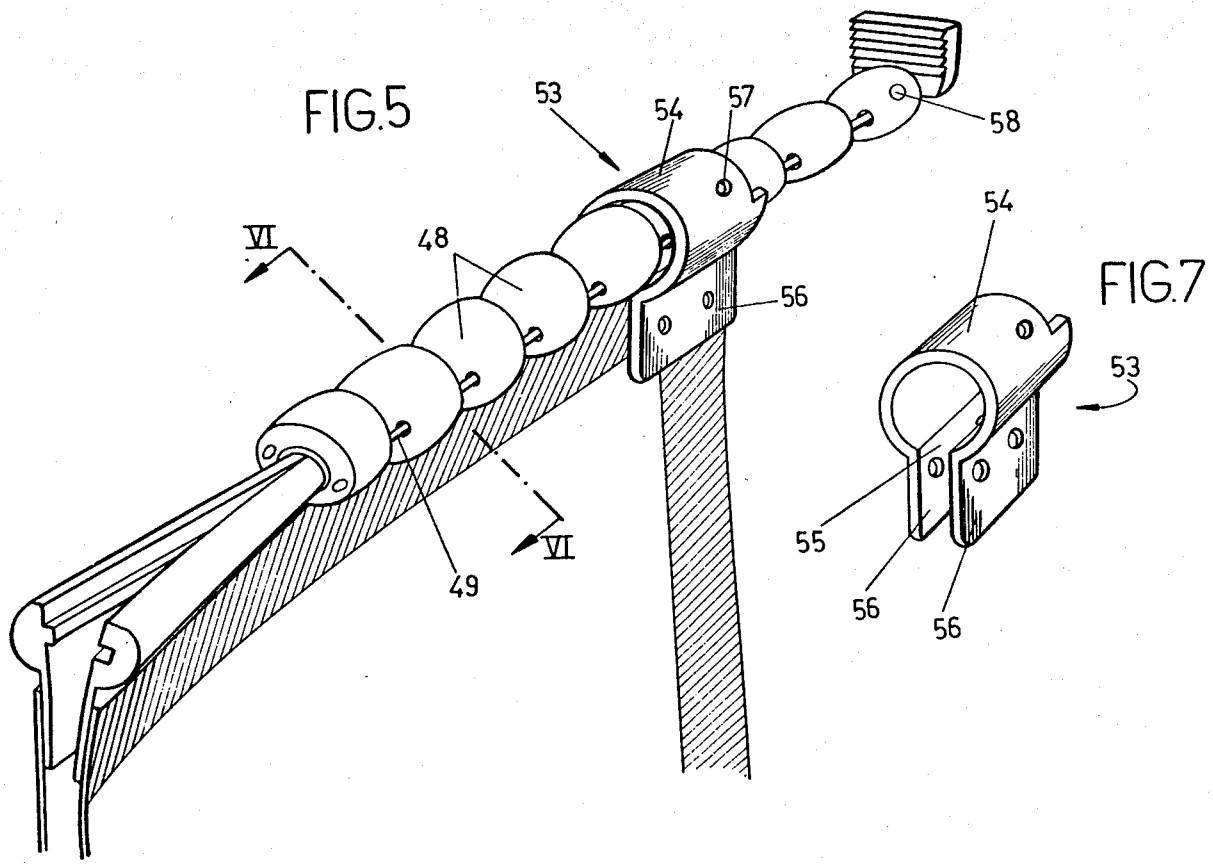
FIG. 5 is a perspective view of a second embodiment of the invention.
FIG. 7 is a perspective view of an element of the device of FIG. 5.
Figure 6:
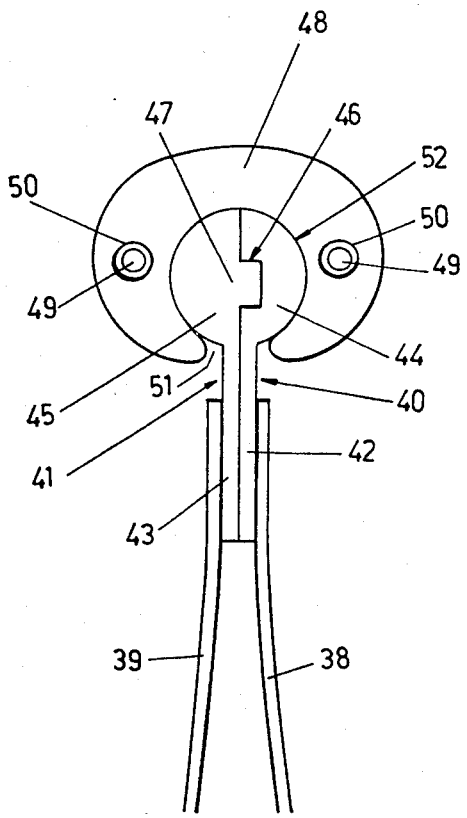
FIG. 6 is a sectional view taken in the plane VI—VI of FIG. 5.

An alternative embodiment is shown in FIGS. 5 and 6, where an envelope is shown open along one of its edges. To the edges of the two sheets 38, 39 which form the envelope are attached tracks 40, 41, which comprise a planar part 42, 43 respectively, to which an enlarged rib 44, 45 is attached along one edge. As can be seen from FIG. 6, the two tracks when placed together, form a substantially cylindrical rail on which a sliding element similar to those previously described may run.

An advantageous feature of the tracks 40 and 41 is the interlocking groove and rib 46 and 47, which prevents the introduction of a thin tool between the tracks, and also serves to align the tracks, preventing relative movement therebetween.

The sliding closure element is formed of a number of segments 48, as before, held together by a flexible filament 49 passing through aligned holes 50 in each segment 48.

Each segment is generally of cylindrical form and has an axial slot 51 at its lower side communicating with a cylindrical bore 52 substantially equal in size to the rail formed by the rib portions 44 and 45 of the tracks 40 and 41.

At one end of the tracks 40, 41, a guide element 53 is positioned, the guide element comprising a tube 54 having a longitudinal slot 55 along the sides of which two radially extending flanges 56 are formed.

The guide member is fixed so that the rail is substantially concentric with the tube and the flanges 56 are then fixed together, for example by means of rivets or welding, to trap the envelope material and the tracks 40 and 41.

To the other end of the rails, which is open in FIG. 6, is attached a stop element of a form similar to the guide element 53 but having the end of its tube blanked off by a wall, so that a segment of the sliding element may enter the tube and be inaccessible therein. The length of the sliding element is such that when its leading segment enters the stop element, its trailing segment comes into a position in which cooperating formations on the guide element and the trailing segment may be used to immobilise the trailing segment relative to the guide element. These cooperating formations may be aligned holes 57 and 58 as shown in FIG. 5, or may be any other formation preferably allowing the use of a resilient plastics seal element such as described earlier.

Figure 8:
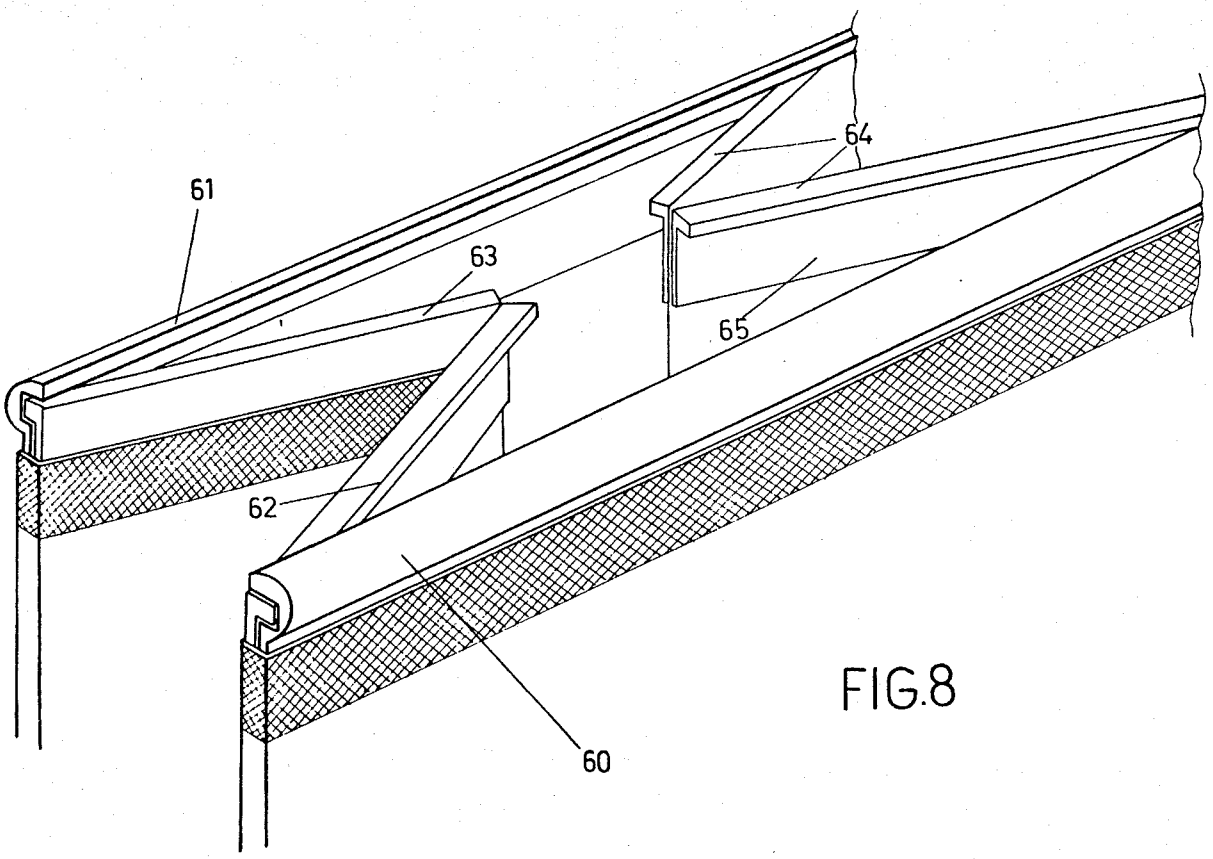
FIG. 8 is a view of a bag neck adapted to receive a third type of closure device of the present invention.
Figure 9:
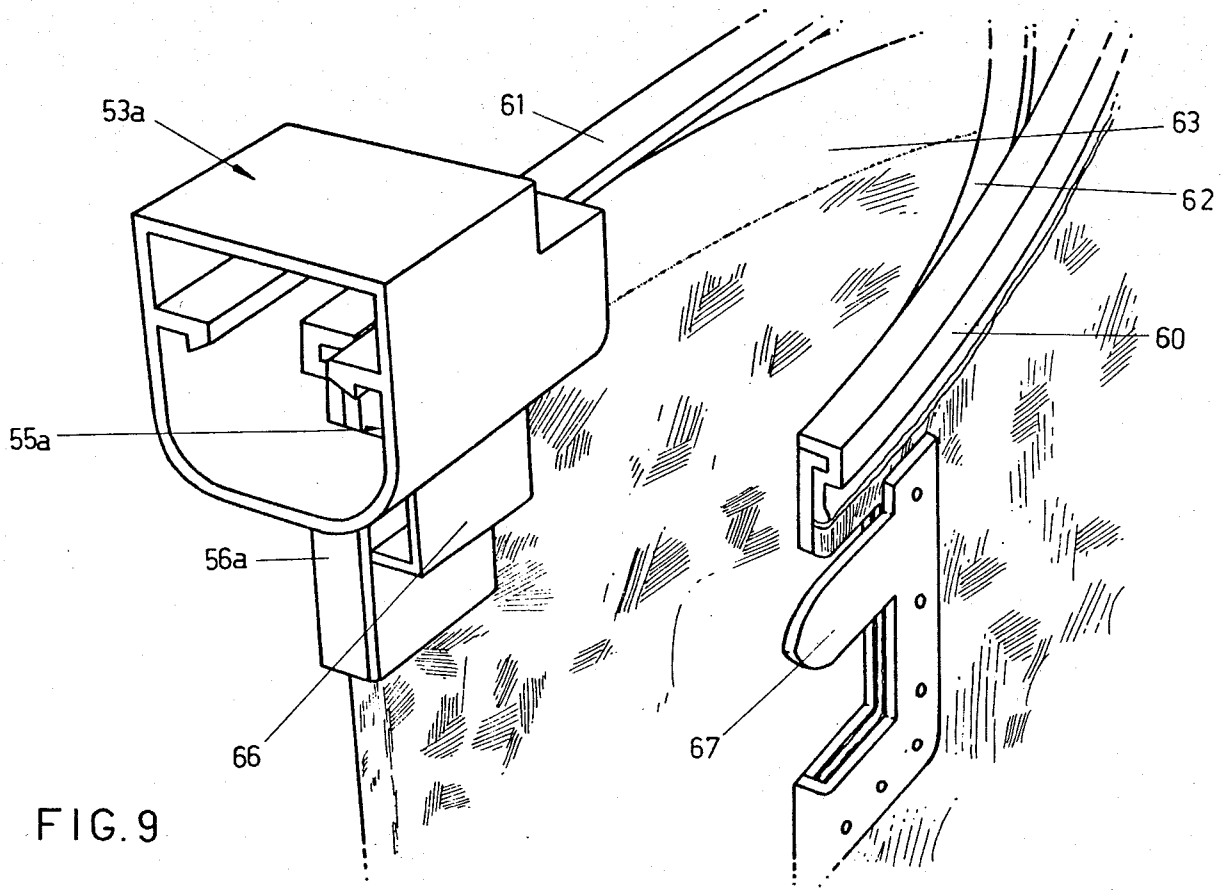
FIG. 9 is a detail of a second variation of the third embodiment of the invention.

In two variations of a third embodiment of the invention, the closure is adapted for use on a bag, the neck of which is provided with two elongated outer rails arranged on opposite sides of the neck, and four inner rails arranged in two pairs and attached to the bag neck between the ends of the outer rails, as is seen in FIGS. 8 and 9.

The outer rails 60, 61 and inner rails 62, 63, 64, 65 fold in the manner of an accordion to present a straight edge, the inner rails accommodated in grooves defined by the outer rails when the bag is closed. The alternative configurations may be seen from the embodiments of FIGS. 8 and 9.

A sliding closure element similar to that described in relation to the second embodiment of the invention is used with this embodiment, preferably with guide and stop elements being provided at the ends of one of the outer rails. The guide and stop elements may be provided on extended parts of the outer rails, situated beyond the part where the end of an inner rail joins the outer rail.

As seen in FIG. 9, the guide element 53*a* and stop element may be similar to those used in the second embodiment, save that only one outer rail is fixed to the flange 56*a* of the guide or stop element, and the other outer rail end may be inserted and withdrawn selectively from the slot 55*a* in the guide or stop element 53*a*.

To ensure elignment between the rails, flange 56*a* may be provided with a socket 66 which is engaged by a tongue 67 mounted on the other outer rail 60.

As shown in FIGS. 8 and 9, the inner rails are of L-shaped cross-section, but they may have any suitable form.

In the three embodiments described, the segments forming the sliding closure are joined by a filament 22, 49. This filament may be of resistant plastics material, or metal wire or any other flexible material, such as glass-reinforced plastics.

In addition to holding the segments together, the filaments serve to align the segments as they are fed on to the track ends as the device is closed.

The closure may also include, in each embodiment, segments formed with finger grips. These segments would be placed at or near the ends of the closure and serve not only to facilitate operation of the device, but also to keep the closure attached to the remainder of the device when the closure is opened.

The aligned bores through which the filaments 22, 49 pass may be configured in such a way as to provide stress-concentration locations which, when an entry is attempted into the envelope or bag by forcing the tracks 2, 3 or 40, 41 or 60, 61 apart, cause breakage of the segments. Clearly the segments must be sufficiently strong to resist normal wear.

The tracks 2, 3, 40, 41 and 60 to 65 may be of plastics material or of metal, preferably of plastics to reduce weight and avoid rust. If the bag is formed of a plastics material, the tracks may even be formed from the material of the bag itself.

I claim:

1. A sliding closure device of an opening in a bag or the like, characterized by including two track parts which extend along opposite sides of the opening, each said track part comprising a rail and a fixing portion for attaching the rail to the bag fabric, an elongate closure element comprising a plurality of substantially identical articulatedly joined segments which have a total length substantially equal to the length of the opening, each segment having at least one passageway extending in the longitudinal direction of the closure element and an open slot communicating with each passageway along its length, the rails each being slidingly receivable in a respective passageway, each said fixing portion being joined to the bag fabric and extending from the bag fabric through a said slot to its respective rail portion.

2. A sliding closure device according to claim 1, characterized in that each segment of the closure element has a single passageway of approximately circular cross-section, the slot extending radially from the passageway, and each track part having a rail of substantially semicircular configuration with a flat face, the rails being arranged in such a way as to fill the passageway, and the fixing portion of each rail comprising a flange extending radially in the plane of the flat face of the rail.

3. A sliding closure device according to claim 2, characterized in that the flat faces of the rails are provided with a complementary tongue-and-groove arrangement.

4. A sliding closure device according to claim 1 for use on a folded bag end, including two outer track parts and characterized by further comprising four inner track parts, each inner track part having an end connected to an end of an outer track part, the track parts in their open position defining a rectangular opening with the outer track parts parallel to each other to form two sides of the opening, and in the closed position each inner track part lying parallel and adjacent to the outer track part to which it is connected.

5. A sliding closure device according to claim 4, characterized in that the outer track parts have a groove in their inwardly-facing sides, said groove receiving in the closed position a lip formed on each inner track part.

6. A sliding closure device according to claim 5, characterized in that the rail of each outer track part is substantially rectangular in cross-sectional shape.

7. A sliding closure device according to claim 4, characterized in that at one adjacent pair of ends of the outer track parts there are provided male and female alignment means.

8. A sliding closure device according to claim 1, characterized in that each segment has two substantially circular-section passageways, and the track parts comprise circular-section rails with radially extending fixing portions.

9. A sliding closure device according to claim 1, characterized in that the device includes at one end of the track parts a guide tube, through which the closure element may slide.

10. A closure device according to claim 9, characterized in that the closure element is provided at or near one or both of its ends with a grip portion of a size and shape which prevents separation of the closure element from the remainder of the device.

11. A sliding closure device according to claim 9, characterized in that complementary formations are provided on the closure element and the guide tube to enable the closure element to be immobilised in its closed position.

12. A sliding closure device according to claim 9, characterized in that the device further includes a stop element at the end of the track parts remote from the guide tube.

13. A closure device according to claim 12, characterized in that the closure element and the stop element are provided with means to enable their relative immobilization.

14. A closure device according to claim 1, characterized in that the segments of the closure element are articulatedly joined by means of a flexible filament or filaments extending through aligned bores in the segments.

* * * * *